US007111573B2

(12) United States Patent
O'Reilly

(10) Patent No.: US 7,111,573 B2
(45) Date of Patent: Sep. 26, 2006

(54) DEVICE AND METHOD FOR MOORING A WATERCRAFT

(76) Inventor: L. Patrick O'Reilly, 138 Palm Coast Parkway, NE., Palm Coast, FL (US) 32137

( * ) Notice: Subject to any disclaimer, the term of this patent is extended or adjusted under 35 U.S.C. 154(b) by 0 days.

(21) Appl. No.: 11/005,359

(22) Filed: Dec. 6, 2004

(65) Prior Publication Data

US 2006/0118025 A1 Jun. 8, 2006

(51) Int. Cl.
*B63B 21/00* (2006.01)

(52) U.S. Cl. ..... 114/230.2; 114/230.26; 24/129 R; 24/130

(58) Field of Classification Search ..... 114/230.26, 114/230.2, 218; 24/129 R, 130
See application file for complete search history.

(56) References Cited

U.S. PATENT DOCUMENTS 3,094,755 A * 6/1963 Casanave ..... 24/129 R
4,414,712 A * 11/1983 Beggins ..... 24/129 R
4,912,816 A * 4/1990 Brandt ..... 24/129 R
5,033,169 A * 7/1991 Bindon ..... 24/129 R
5,339,498 A * 8/1994 Parsons ..... 24/129 R

* cited by examiner

*Primary Examiner*—Ed Swinehart
(74) *Attorney, Agent, or Firm*—Laura Barrow

(57) ABSTRACT

A novel mooring line device is described and illustrated. The mooring line device is designed to engage a mooring line, the mooring line having a free end for attachment to a watercraft and a looped end for attachment to the mooring line device. The inventive mooring line device comprises two tubes, secured adjacent to one another, through which the mooring line is threaded. Once the mooring line is wrapped about a piling, the looped end of the mooring line may be engaged within a locking component of the mooring line device, and the mooring line subsequently tightened about the piling and secured thereto via the inventive mooring line device.

11 Claims, 3 Drawing Sheets

DEVICE AND METHOD FOR MOORING A WATERCRAFT

BACKGROUND AND SUMMARY

The present invention is directed to a device and method for mooring a watercraft to dock pilings. The device is configured to engage a portion of a mooring line, such as a rope, which can then be readily cast toward a piling. The rope can be wrapped around the piling, and a looped end of the rope can be hooked into the locking component of the device. The free end of the rope may be tied to a cleat on the outside of the boat, for example.

In certain aspects, the present invention is directed to a mooring line device comprising: (a) an elongated first tube having an inner channel for housing a portion of the mooring line, the tube having an open top end, an open bottom end, and a longitudinal length; (b) a second tube having an inner channel for housing a second portion of the mooring line, the second tube having an open top end, an open bottom end, and a longitudinal length. The second tube is connected adjacent to the first tube and is positioned with respect to the first tube such that the inner channels of the tubes run substantially parallel to one another. The mooring line device further includes a locking component integral with the first tube, the locking component configured to secure a looped end of the mooring line thereto.

One embodiment of the locking component of the present invention comprises an elongated finger having one end integral with the first tube and a free end extending downward. The locking component of this embodiment further includes a boss integral with the first tube and positioned near the bottom end of the first tube adjacent the free end of the finger, thereby providing a space sufficiently large to allow the looped end of the mooring line to slide between the boss and finger for engagement therein.

Other embodiments of the present invention include a kit comprising a mooring line and the mooring line device described and illustrated herein, as well as a method of using the mooring line device to secure to a watercraft to a piling.

DETAILED DESCRIPTION OF THE PREFERRED EMBODIMENTS

Figure 1:
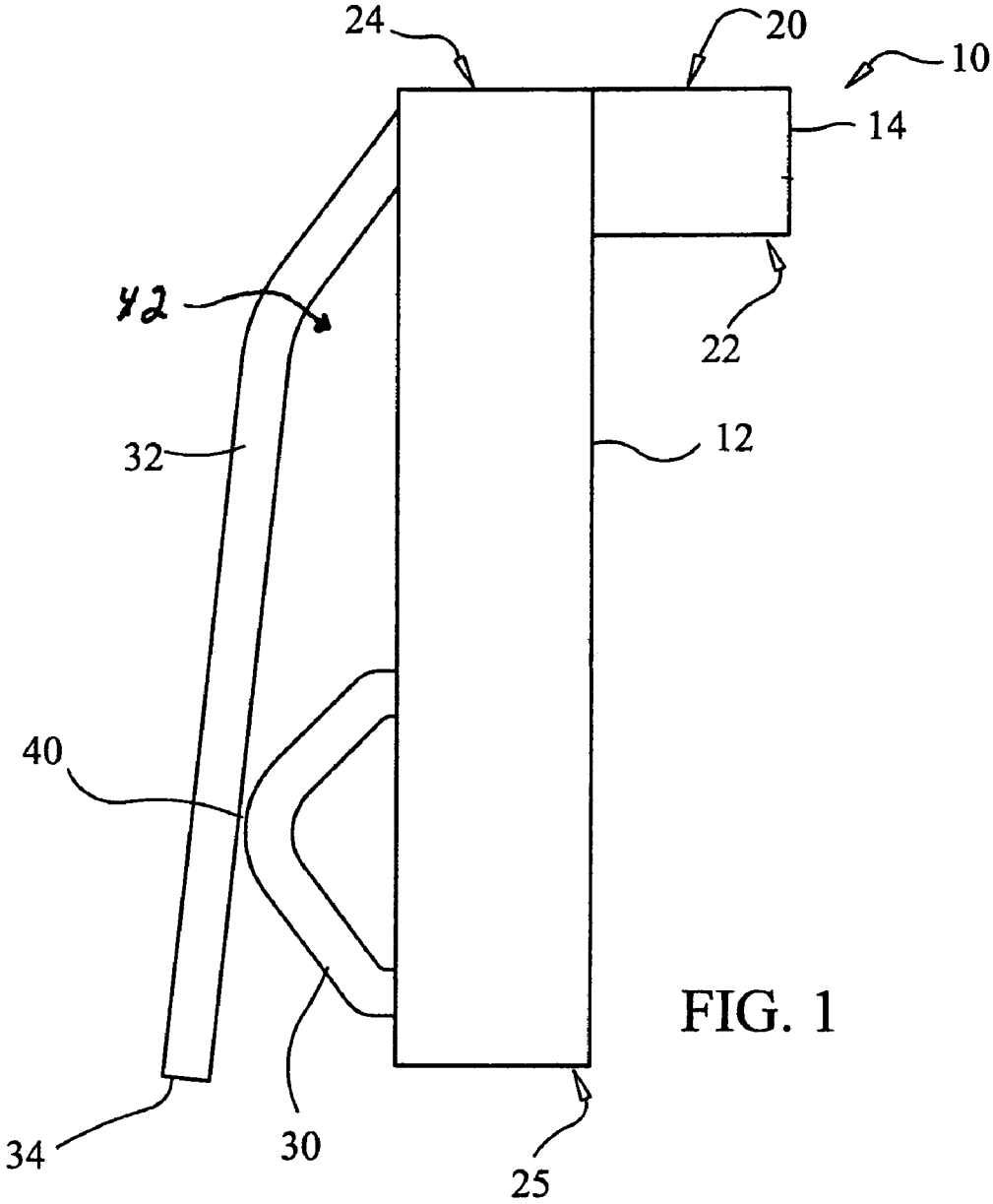
FIG. 1 is a side view of one embodiment of the inventive mooring device.
Figure 2:
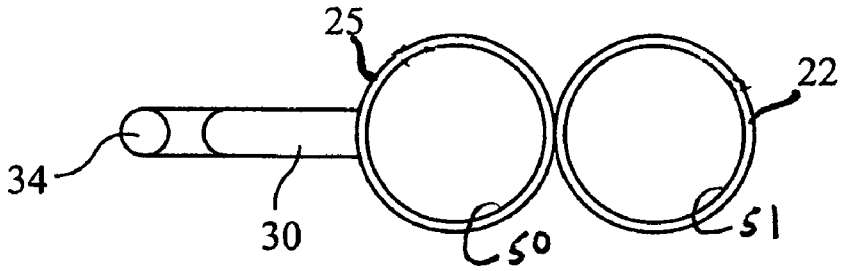
FIG. 2 is a bottom view of the embodiment illustrated in FIG. 1.

Referring now to the figures, the inventive mooring device 10 comprises an elongated first tube 12 having an inner channel 50 for housing a portion 11 of the mooring line 1. The first tube further includes an open top end 24 and an open bottom end 25. The length of the tube 12 is measured from its top end 24 to its bottom end 25. The mooring line device 10 further includes a second tube 14 also having an inner channel 51 for housing a second portion 13 of the mooring line, the second tube 14 having an open top end 20 and an open bottom end 22. Like the first tube, the length of the second tube is measured from its top end 20 to its bottom end 22. The second tube 14 is connected to the first tube as shown in the figures, such that the inner channels 50, 51 of the tubes run substantially parallel to one another. Preferably, the top end 20 of the second tube is flush or level with the top end 24 of the first tube. [The term "substantially" as used herein includes slight variations in angle or alignment of the second tube with respect to the first tube due, for example, to manufacturing deviations. Thus, the second tube may in fact be bent slightly downward or upward such that the respective inner channels of the tube tubes are not exactly parallel, but are sufficiently parallel to allow the mooring line to be effectively secured to the mooring line device as described and illustrated herein].

The mooring line device 10 further includes a locking component integral with the first tube. In one embodiment, the locking component comprises an elongated finger 32 having one end integral with the first tube 12 and a free end 34 extending downward. The locking component further includes a boss 30 that is also integral with the first tube as shown. Preferably, the boss 30 is positioned near the bottom of the first tube and adjacent the free end 34 of the finger to allow a space 40 that is sufficiently large to allow the looped end 3 of the mooring line 1 to slide between the boss 30 and fingers 32 for engagement therein, preferably within a larger space 42 formed between the finger 32 and boss 30.

Figure 6:
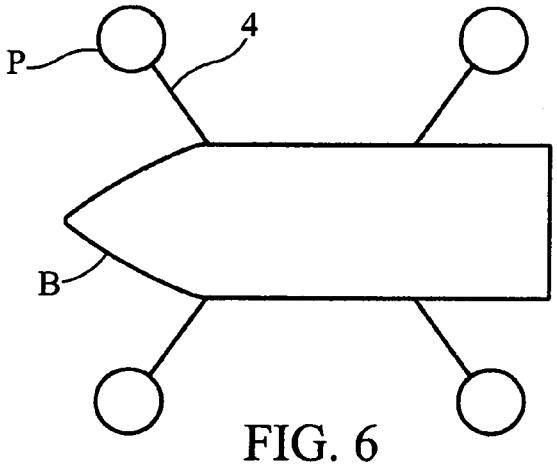
FIG. 6 is a schematic top view showing a watercraft secured to four pilings.

As discussed above, the inventive mooring line device is designed to engage a mooring line for securing a watercraft B, such as a boat, to a piling P. One device is used per mooring line. FIG. 6 illustrates four mooring lines 4 used for docking a boat B to four respective pilings P, for example. As used herein, the term "watercraft" includes any vehicle designed for operation on any waterway and includes, but is not limited to, outboard motor boats, jet skis, inboard motor boats, pontoon boats, sailboats, jet boats, and the like. Moreover, pilings include those standing alone as well as those that form a part of a boat dock.

Figure 3:
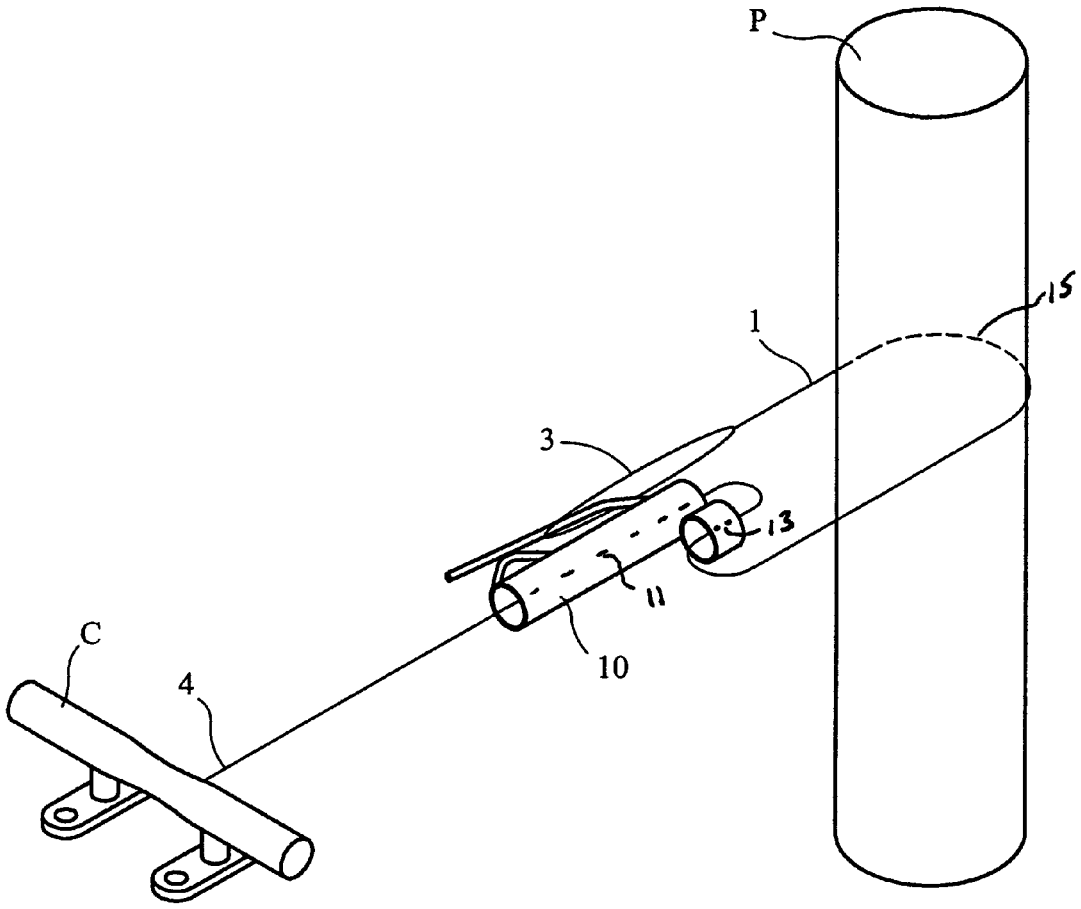
FIG. 3 is a perspective view of the inventive mooring device in use.
Figure 4:
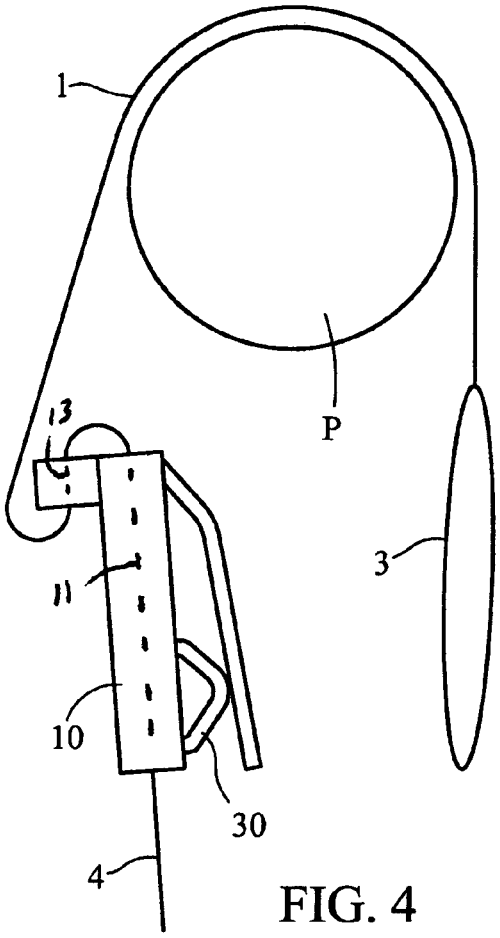
FIGS. 4 and 5 are top views illustrating how a mooring line is threaded through the mooring line device and the securing of the mooring line about a piling and to the mooring line device.
Figure 5:
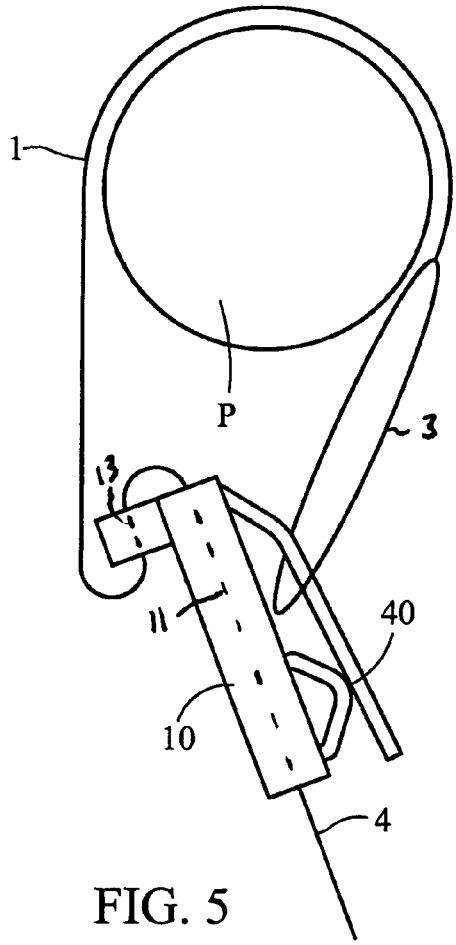

Prior to securing the mooring line 1 to the piling(s) P, the free end 4 of the mooring line is first threaded through the inventive mooring line device 10. This is preferably accomplished by first threading the free end of the mooring line through the bottom end 22 of the second tube 14, out through the top end 20 of the second tube, then through the top end 24 of the first tube 12, and finally out through the bottom end 25 of the first tube 12 (see FIG. 4). The looped end 3 of the mooring line is then slid through the tight space 40 formed between the finger 32 and the boss 30 of the locking component (see FIGS. 1 and 5). This space 40 is sufficiently large to allow the mooring line to slide through with some force, but small enough to prevent the looped end 3 from slipping out unless forcibly pulled out by the operator, for example. In fact, the finger 32, preferably, has some minimal resiliency such that its free end 34 moves slightly outward as the looped end 3 of the mooring line passes between the finger 32 and the boss 30, slightly pushing the finger 32 outward as it passes by into the large space 42 formed by the locking component. A portion 15 of the mooring line that is located between the mooring line device and the looped end of the mooring line is then wrapped around a piling P (FIG. 3). The looped end 3 of the mooring line is then engaged within the locking component, as described earlier. The mooring line, namely the wrapped portion 15 of the mooring line, may then be tightened about the piling by pulling upon a portion of the mooring line extending from the bottom end 25 of the fist tube (i.e. between the bottom end of the first tube and the free end 4 of the mooring line). The free end 4 of the mooring line may then be secured to the watercraft, preferably by wrapping it about one or more of the watercraft's cleats C (see FIG. 3, the watercraft not shown).

The figures provided herein illustrate preferred dimensions and shapes for the inventive mooring line device; however, it will be appreciated by those of ordinary skill in the art that such dimensions and shapes may be modified and still be within the scope and spirit of the invention and claims described herein. For example, the mooring line device illustrated in the figures comprises a second tube 14 having a shorter length than first tube 12, although if desired, the second tube could be the same length or longer than the first tube. Preferably, however, the second tube 14 has a length that is about fifty percent or less the length of the first tube, and more preferably, about twenty-five percent or less the length of the first tube 12. Similarly, both the finger 32 and boss 30 of the locking component may be of different lengths and sizes, provided a space 42 is present between these two components to engage the looped end 3 of the mooring line, and that the locking component is configured to maintain the looped end of the mooring line therein until forcibly removed by the operator or other occupant of the watercraft, for example. Also, the figures presented herein illustrate an arcuate or ring-shaped boss; however, the configuration of the boss may be substantially modified, provided the boss comprises a relatively rigid protrusion extending along the first tube and substantially adjacent the finger 32 to form the necessary spaces 40, 42 as just described.

Moreover, a variety of materials (e.g. metals, metal alloys, polymeric compounds, etc.) may be used to fabricate the mooring line device; however, heavier materials such as stainless steel, aluminum, or other metals and metal alloys are preferred in order to provide the desired weight to the mooring line in the event the line is tossed from the watercraft from a substantial distance therefrom.

I claim:

1. A method for securing a watercraft to a dock piling, said method comprising:

a) securing a mooring line device to a mooring line, said mooring line having two opposite ends, wherein one of said opposite ends is a free un-looped end and the second of said opposite ends is a looped end; and wherein said mooring line device includes (i) an elongated first tube having an inner channel for housing a portion of a mooring line, said tube having an open top end, an open bottom end, and a longitudinal length, (ii) a second tube having an inner channel for housing a second portion of said mooring line, said second tube having an open top end, an open bottom end, and a longitudinal length, and wherein said second tube is connected adjacent to said first tube and positioned with respect to said first tube such that the inner channels of said tubes run substantially parallel to one another; and (iii) a locking component integral with said first tube, said locking component configured to secure a looped end of the mooring line thereto;

b) wrapping around a piling a portion of the mooring line, said portion located between the mooring line device and the looped end of the mooring line;

c) engaging within the locking component of the mooring line device the looped end of the mooring line; and d) tightening the wrapped portion of the mooring line about said piling by pulling upon a second portion of the mooring line, said second portion located between the bottom end of the first tube and the free un-looped end of the mooring line.

2. The method of claim 1, further including securing said free un-looped end of the mooring line to said watercraft.

3. The method of claim 1, wherein said locking component comprises an elongated finger having one end integral with said first tube and a free end extending downward, said locking component further including a boss integral with said first tube, said boss positioned near the bottom end of the first tube adjacent the free end of said finger to allow a space sufficiently large to allow the looped end of the mooring line to slide between said boss and fingers for engagement therein.

4. The method of claim 2, further including securing said free un-looped end of the mooring line to said watercraft.

5. The method of claim 1, wherein said securing comprises, in a series, threading the free un-looped end of the mooring line first through the bottom end of the second tube, through the top end of the second tube, through the top end of the first tube, and finally through the bottom end of the first tube.

6. The method of claim 5, further including securing said free un-looped end of the mooring line to said watercraft.

7. The method of claim 5, wherein said locking component comprises an elongated finger having one end integral with said first tube and a free end extending downward, said locking component further including a boss integral with said first tube, said boss positioned near the bottom end of the first tube adjacent the free end of said finger to allow a space sufficiently large to allow the looped end of the mooring line to slide between said boss and fingers for engagement therein.

8. The method of claim 1, wherein the length of said second tube is about fifty percent or less of the length of the first tube.

9. The method of claim 8, wherein the length of said second tube is about twenty-five percent or less of the length of the first tube.

10. The method of claim 5, wherein the length of said second tube is about fifty percent or less of the length of the first tube.

11. The method of claim 10, wherein the length of said second tube is about twenty-five percent or less of the length of the first tube.

* * * * *